US005609935A

United States Patent [19]

Yamagata et al.

[11] Patent Number: 5,609,935

[45] Date of Patent: Mar. 11, 1997

[54] FUR-LIKE PILED FABRIC AND METHOD FOR PRODUCTION THEREOF

[75] Inventors: Seiichi Yamagata, Ohtu; Hidenobu Honda, Kouka-gun, both of Japan

[73] Assignee: Toray Industries, Inc., Japan

[21] Appl. No.: 330,118

[22] Filed: Oct. 27, 1994

Related U.S. Application Data

[63] Continuation of Ser. No. 859,518, filed as PCT/JP91/01350, Oct. 4, 1991, published as WO92/06233, Apr. 16, 1992,, abandoned.

[30] Foreign Application Priority Data

Oct. 9, 1990 [JP] Japan ..... 2-271363

[51] Int. Cl.[6] ..... B32B 3/02; D06C 23/02; D06C 29/00; D03D 39/22

[52] U.S. Cl. ..... 428/89; 428/92; 28/160; 28/162; 28/163; 26/2 R; 26/14; 8/115.69

[58] Field of Search ..... 428/89, 92; 28/160, 28/162, 163; 26/14, 2 R; 8/115.69

[56] References Cited

U.S. PATENT DOCUMENTS

| | | | |
|---|---|---|---|
| 3,930,106 | 12/1975 | Mihara et al. | 161/179 |
| 4,332,585 | 6/1982 | Minemura et al. | 8/114.6 |
| 4,525,404 | 6/1985 | Matsui et al. | 428/92 |
| 4,546,020 | 10/1985 | Sakai et al. | 428/89 |
| 4,613,529 | 9/1986 | Yamashita et al. | 428/15 |
| 4,729,215 | 3/1988 | Sato et al. | 57/210 |
| 4,729,913 | 3/1988 | Matsui et al. | 428/15 |
| 4,781,951 | 11/1988 | Kitamura et al. | 428/89 |

FOREIGN PATENT DOCUMENTS

| | | | |
|---|---|---|---|
| 0016450 | 1/1980 | European Pat. Off. . | |
| 0048609 | 3/1982 | European Pat. Off. . | |
| 0070903 | 9/1983 | European Pat. Off. . | |
| 54-28442 | 9/1979 | Japan | 428/89 |
| 55-57069 | 4/1980 | Japan | D06M 9/02 |
| 57-205546 | 12/1982 | Japan | D03D 27/00 |
| 57-205576 | 12/1982 | Japan | D06C 11/00 |
| 1-168936 | 7/1989 | Japan | D03D 27/00 |

*Primary Examiner*—Terrel Morris
*Attorney, Agent, or Firm*—Austin R. Miller

[57] ABSTRACT

This invention is directed to a fur-like pile fabric of two-layer construction formed of guard hair fibers and under-fur fibers and used as artificial fur and a method for the production thereof.

This invention produces a pile fabric 1 possessing guard hair fibers 2 having sharpened leading terminals and under-fur fibers having a satisfactorily uniform length by a method that comprises preparing a pile knitted or woven fabric with a pile yarn obtained by mixing limited-length polyester type fibers for guard hair fibers of sharpened terminals with limited-length polyester type fibers more susceptible to the action of an alkali treating agent and used for under-fur fibers, imparting an alkali treating agent 6 of a specific viscosity to the hair-raised surface of the pile knitted or woven fabric, and thereafter heat-treating the alkali-treated fabric thereby shortening the under-fur fibers and sharpening the leading terminals of the under-fur fibers.

8 Claims, 3 Drawing Sheets

(Before treatment)

(Before treatment)

(After impartation of alkali agent)

(After pressing)

(After treatment)

FUR-LIKE PILED FABRIC AND METHOD FOR PRODUCTION THEREOF

This application is a continuation of application Ser. No. 07/859,518, filed as PCT/JP91/01350, Oct. 4, 1991, published as WO92/06233, Apr. 16, 1992, now abandoned.

FIELD OF THE INVENTION

This invention relates to a novel piled fabric to be used as artificial fur and a method for the production thereof.

More particularly, this invention relates to a novel fur-like piled fabric that very closely resembles natural high-quality fur in texture and particularly offers an ideal appearance with regard to pile compared with the conventional countertype and natural fur, and is light weight fabric compared with the conventional countertype fabric and relates to a method for the production of the fur-like piled fabric.

BACKGROUND OF THE INVENTION

Natural high-quality mink and fox fur enjoy exquisite gloss, and texture and defy attempts at manufacturing imitations thereof. Thus, natural furs remain expensive. As a status symbol or as super-high class fashion material for clothing, therefore, the natural furs remain in demand.

In the meantime, movements for the prevention of cruelty to animals and for the preservation of natural environments have been steadily gaining ground. The desirability of developing artificial fur closely resembling natural fur, therefore, has found approval and has aroused general interest.

Numerous piled fabrics have been proposed to date, some deserving the plain descriptive phrase "resembling blankets" and others genuinely deserving the promotional phrase "comparing favorably with natural furs."

The growing enthusiasm advocating the prevention of cruelty to animals has been encouraging the perfection of numerous inventions directed to the production of artificial fur-like piled fabrics in recent years.

Concerning the production of artificial furs, for example, the inventions disclosed in Japanese Unexamined Patent Publication No. 85,361/1974 and Japanese Utility Model Publication No. 15,816/1974 have been known to the art. Neither of the inventions, however, is fully satisfactory from a comprehensive point of view.

U.S. Pat. No. 2,737,702 discloses an invention relating to the production of an artificial fur using guard hair fibers tapered at opposite terminals in the sliver knitting. This artificial fur, however, has the disadvantage that guard hair fibers have poor affinity for the under-fur fibers, the guard hair fibers and the under-fur fibers are entwined or the adjacent under-fur fibers are mutually entwined, and these raised piles tend to collapse and the layer of raised piles lacks stiffness.

Japanese Unexamined Patent Publication No. 61,741/1982 discloses an invention relating to a special fur-like piled fabric and a method for the production thereof. This invention pays no due consideration to the length of under-fur fibers or to the uniform distribution of hair length. The fur-like piled fabric produced by the method of that invention does not clearly show a two-layer piled texture similar to natural mink fur. Further, the piled part of this fabric constitutes an aggregate of long hairs and short hairs like the tip of a writing brush and, as a result, the raised piles are liable to entwine. When this fur-like piled fabric is converted into a cut pile fabric by cutting the raised loops thereof, the newly formed raised piles take up blunt chopped end faces, which impart a coarse touch to the surface of the cut pile fabric and make the cut pile fabric assume a whitely blurred appearance. In terms of the spinnability of the fibers for the pile, the allowable working staple length of fibers for flurry hairs has its limit on the short side because spinnability declines with decreasing staple length. The desire to obtain raised piles of short length and make the produced cut pile fabric show clearly a two-layer pile construction is fulfilled only with difficulty. Thus, this invention has much room for further improvement.

Japanese Unexamined Patent Publication No. 95,342/1982 discloses a method for effecting separation of multiple pile fabrics by applying a sliding separation force to component fibers of pile yarns in the multiple pile fabrics. That invention forms an effective improvement in the process over the method disclosed in the aforementioned Japanese Unexamined Patent Publication No. 61,741/1982. Similar to the product of this Japanese Unexamined Patent Publication No. 61,741/1982, the product of that invention shows no clear two-layer texture and has a poor appearance. Moreover, it has the disadvantage that the raised piles in the pile fabric form an aggregate of hairs like the tip of a writing brush and, as a result, the raised piles tend to be entwined.

Japanese Patent Publication No. 64,536/1988 discloses a pile fabric that exhibits a pile fiber length distribution in which under-fur fibers form a uniform length in the lengths of hairs raised from the ground construction. That technique forms a further improvement over the method disclosed in Japanese Unexamined Patent Publication No. 61,741/1982. Similar to the technique disclosed in Japanese Patent Publication No. 61,741/1982, that technique relies for conversion into a cut pile fabric on the severance of pile fibers and, therefore, has the disadvantage that the cut ends of the under-fur fibers are blunt ends resembling nail heads, the raised piles are liable to be entwined, and the pile fabric is not satisfactory with regard to surface touch or appearance.

DISCLOSURE OF THE INVENTION

An object of this invention is to eliminate the problematic aspects of the prior art mentioned above and, for this purpose, provide a novel fur-like pile fabric that very closely resembles a natural high-quality fur in texture, excels in the appearance of the layer of raised piles compared with the conventional countertype or natural fur, solves the problem of the appearance of the layer of raised piles which necessitated an increase in the number of raised piles and consequently entails a notable addition to the weight of the produced pile fabric owing to the nature inherent in a pile fabric, and therefore this product is far superior to the conventional countertype.

To accomplish the object described above, the fur-like pile fabric of this invention is constructed as follows.

To be specific, the fur-like pile fabric of this invention is a pile fabric having a two-layer pile construction consisting of a layer of guard hair fibers formed of polyester type fibers and tapered at the leading ends thereof and a layer of under-fur fibers formed of polyester type fibers of a smaller height than the layer of guard hair fibers, the fur-like pile fabric which is characterized in that the under-fur fibers possess a raised hair length distribution containing a part in which the hairs raised from the ground construction have a uniform length and the under-fur fibers in the aforementioned part of the raised piles of uniform length have tapered leading ends and the layer of guard hair fibers possess a raised hair length distribution having lengths of hairs raised from the ground construction ranging from near zero to the proximity of the available maximum fiber length of the guard hair fibers.

This invention is further directed to a method for the production of a fur-like pile fabric, characterized by blending limited-length polyester type fibers tapered at leading ends thereof and intended for guard hair fibers with limited-length polyester type fibers rendered more vulnerable to alkali treatment and intended for under-fur fibers thereby forming pile fibers, knitting or weaving the pile fibers thereby obtaining a pile fabric, providing a backing treatment to the rear side of the pile fabric, manipulating the pile fabric, applying to the hair-raised surface part of the pile fabric an alkali treating agent possessing viscosity in the range of from 100 to 500 poises, and then subjecting the pile fabric to a dry heat treatment or wet heat treatment thereby shortening the under-fur fibers to not more than 70% of the longest guard hair fibers and, at the same time, sharpening the leading end parts of the under-fur fibers.

The pile fabric that is obtained by this invention has the same clear two-layer structure as natural mink fur because the under-fur fibers are shortened to not more than 70% of the longest guard hair fibers and are tapered at the leading end parts thereof and possess a part in which the hairs raised from the ground construction have a uniform length.

Some of the conventional methods are known to use crimped fibers for under-fur fibers. In the case of the pile fabric produced by such a method, the raised piles tend to be mutually entwined because of their crimps. Further, since the roots of the raised piles of the pile fabric are in a very compact bundled structure owing to the kind of blending of different species of fibers as described above, each raised pile forms an aggregate of hairs resembling the tip of a writing brush and the adjacent under-fur fibers tend to be mutually entwined or the under-fur fibers and the guard hair fibers tend to be entwined. Even from this point of view it is safe to conclude that the raised piles tend to be entwined. This entwining notably degrades the appearance and the bending and trailing property of the pile fabric and impairs the grade and quality of the pile fabric as a commodity.

In contrast to the product of the conventional method described above, the fur-like pile fabric of this invention, even when the same crimped fibers as adopted by the conventional method are used for under-fur fibers, has under-fur fibers thereof shortened to not more than 70% of the longest guard hair fibers and tapered at the leading ends thereof by the use of an alkali treating agent possessing an increased viscosity falling in a specific range. As a result, the fur-like pile fabric consisting of a layer of guard hair fibers and a layer of under-fur fibers shows has an obvious two-layer structure and produces a greater visual sensation of guard hair fibers. The fact that the raised piles succumb only slightly to entwining notably improves the appearance and the bending and trailing properties of the fur-like pile fabric. Particularly when the produced fur-like pile fabric is finished in a dark color, the under-fur fibers of this product do not produce a foggy appearance and the fur-like pile fabric does not emit a whitish appearance because the under-fur fibers have a greater length. This product produces a decisively dark appearance because the under-fur fibers that form the inner of the two layers of the raised piles are distinctly separated (entwined only slightly) and, therefore, do not produce a whitish appearance.

Owing to the effects described above, the characteristic properties of fur-like fabric in appearance, color, and gloss as evinced by the depth of color of the inner layer of raised piles and the depth of color of the fur-like pile fabric as a whole; the consequent high-grade and three-dimensional feeling of the layers of the raised piles, and the feeling of gloss give the fur-like pile fabric a high-quality feeling.

Further, since the under-fur fibers are allowed a reduction in length, the produced fur-like pile fabric acquires a smaller basis weight than the countertype produced by the conventional method and, therefore, is light weight. This fact makes a coat made of the fur-like pile fabric comfortable.

BRIEF DESCRIPTION OF THE DRAWINGS

FIG. 1 (*a*) is a schematic model side view aiding in the description of the piling and FIG. 1 (*b*) is a schematic diagram illustrating one bunch of either guard hair fibers or under-fur fibers as shown in FIG. 1 (*a*) and cut off near the root, as viewed from above.

FIG. 2 (*a*) illustrates, as a model, a pile fabric comprising raised piles formed of fibers tapered at opposite ends thereof and intended for guard hair fibers and fibers substantially equal in length thereto, not tapered at the opposite ends thereof, and intended for under-fur fibers and not yet subjected to an alkali treatment of the method of this invention, FIG. 2 (*b*) illustrates, as a model, the state that the pile fabric of FIG. 2 (*a*) assumes after application thereto of an alkali treating agent possessing a specific viscosity, and FIG. 2 (*c*) illustrates, as a model, the pile fabric that has undergone the alkali treatment of the method of this invention.

DETAILED DESCRIPTION

Figure 1A:
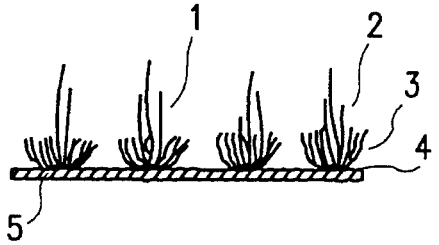
FIG. 1 illustrates one example of the structure of a pile fabric of this invention.

As concrete examples of the polyester type fiber, polyethylene terephthalate, polybutylene terephthalate, and copolymers formed mainly of such terephthalates may be cited. As the fibers for guard hair fibers, for example, it is desirable to use polyester type fibers having a thickness of not less than 3 deniers and not more than 100 deniers and exhibiting high resistance to alkalis. As fibers for under-fur fibers, it is desirable to use polyester type fibers having a thickness of not more than 5 deniers and exhibiting low resistance to alkalis. It is particularly desirable to use as limited-length fibers for guard fibers such polyester type fibers as are formed of polybutylene terephthalate or a copolymer having polybutylene terephthalate as a main component or such polyester type fibers as are produced by blending polybutylene terephthalate as a main component with other components and as limited-length fibers for under-fur fibers such polyester type fibers as are formed of polyethylene terephthalate or a copolymer having polyethylene terephthalate as a main component thereof or such polyester type fibers as are produced by blending polyethylene terephthalate as a main component with other components.

The term "limited-length fibers" is intended to encompass staple fibers.

The method of this invention is characterized by blending limited-length fibers formed of such polyester type fibers, tapered at leading ends thereof, and intended for guard hair fibers with limited-length fibers formed of polyester type fibers more vulnerable to an alkali treatment than the polyester type fibers forming the limited-length fibers for the guard hair fibers and intended for under-fur fibers thereby preparing blended pile yarns, knitting or weaving the pile yarns thereby obtaining a pile fabric, giving a backing treatment to the rear side of the pile fabric, further manipulating the pile side of the pile fabric thereby divesting loose fibers reported from the ground structure, subsequently applying to the pile surface of the pile fabric an alkali treating agent possessing a specific magnitude of viscosity, and heat-treating the pile fabric thereby shortening the under-fur fibers to below a specific level relative to the largest length of the guard hair fibers and, at the same time, sharpening the leading ends thereof. As described above, limited-length fibers as the raw material for the guard hair fibers already have their leading ends tapered at the time that they are put to use herein.

As the alkali treating agent, it is desirable to use sodium hydroxide in point of operation and effect as well as economy. For the purpose of adjusting the viscosity of this alkali treating agent in the range of from 100 to 500 poises, it is desirable to use a suitable viscosity enhancer. As the viscosity enhancer, various substances generally referred to as sizing agents are usable. Water-soluble polymers and other similar substances are also usable.

Now, this invention will be described more specifically below with reference to the accompanying drawings.

Figure 1B:
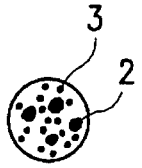

One example of the structure of a fur-like pile fabric contemplated by this invention will be described below with reference to model diagrams. FIG. 1 (*a*) is a schematic model side view illustrating an example of the structure of a fur-like pile fabric obtained by this invention. Guard hair fibers 2 are formed so as to assume a raised hair length distribution having as the maximum thereof substantially the length of fibers as the starting material (the length of the limited-length fibers for guard hair fibers) and under-fur fibers 3 are formed so as to assume a raised hair length distribution containing a portion having as the substantially uniform length thereof the length of hairs raised from a ground construction 4. On the whole, the two-layer structure consisting of a layer of guard hair fibers and a layer of under-fur fibers form a pile fabric 1 of this invention.

The ground construction 4 is either impregnated with such an adhesive polymer as polyurethane or polyacryl or lined with a backing layer 5 or both. When the backing layer 5 is selected, it may be properly formed so as to suit the particular purpose such as, for example, fixation of the raised piles on imitation leather. There are times when omission of the backing layer is permissible.

The roots of individual raised piles, as viewed in the cross section thereof, form a structure of blended yarns comprising a plurality of fibers forming guard hair fibers and a plurality of fibers forming under-fur fibers, namely a pile root structure in which the raised piles of the plurality of fibers gather into one pile bunch. FIG. 1 (*b*) is a schematic diagram illustrating the appearance of one pile bunch of under-fur fibers 3 cut near the roots thereof and viewed from above. It represents a model of the structure of a blended fiber formed of a multiplicity of under-fur fibers 3 and relatively few guard hair fibers 2.

In the pile fabric of this invention, since the pile is formed of spun yarns as described above, the guard hair fibers and the under-fur fibers in the root of each pile bunch are satisfactorily mixed to form a bundle. Owing to this pile root structure that is formed as described above, the pile fabric brings about a high affinity between the guard hair fibers and under-fur fibers.

The fibers as starting material for the guard hair fibers are limited-length fibers having the opposite ends tapered sharply from the beginning. The fibers forming the under-fur fibers are limited-length fibers that are crimped and have been shortened and, at the same time, tapered sharply at the leading ends thereof by the action of an alkali treating agent having the viscosity thereof specifically adjusted to a magnitude in the range of from 100 to 500 poises. These two species of fibers are raised in two states; the fibers are raised on the opposite end sides in one state and they are raised on one end side and substantially buried on the other end side in the other state. Owing to this structure, the pile fabric is covered with guard hair fibers having the leading ends thereof wholly tapered sharply and under-fur fibers possessing crimps, rising to a uniform length from the ground construction, and having the leading ends tapered by the specific treatment. The expression "limited-length fibers for guard hair fibers having tapered opposite ends from the beginning or acquiring tapered ends by the specific treatment" as used herein means those limited-length fibers that have possessed tapered opposite ends already or that have acquired tapered opposite ends by the specific treatment before they are prepared for the formation of the blended yarns.

Now, a preferred embodiment of this invention in the production of the fur-like piled fabric will be described below.

Figure 2A:
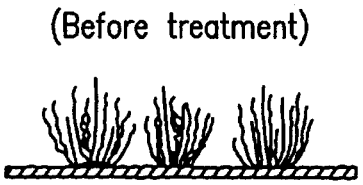
FIGS. 2 (*a*), (*b*), and (*c*) are schematic model side views aiding in the description of a method for the production of the pile fabric of this invention.
Figure 2B:
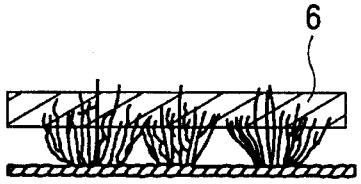
Figure 2C:
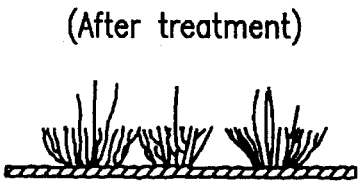

First, a pile fabric comprising fibers tapered at the opposite ends thereof and intended for guard hair fibers and fibers having substantially the same length as the fibers mentioned above, not tapered at the opposite ends thereof, and intended for under-fur fibers is produced as illustrated in FIG. 2 (*a*).

The pile fabric of this description can be produced by the conventional technique disclosed in Japanese Unexamined Patent Publications No. 61,741/1982 and No. 95,342/1982 mentioned above. The length of the limited-length fibers for the guard hair fibers and the length of the limited-length fibers for the under-fur fibers may be equal to each other or different from each other by allowing the latter length to be larger or smaller than the former length. The spinnability of the component fibers during the preparation of blended yarns can be improved by allowing the latter length to be greater than the former length. This superiority of the latter length has an additional merit of increasing the proportion of under-fur fibers that actually undergo the treatment for shortening under-fur fibers, to be described specifically afterward, and also increasing the proportion of under-fur fibers having the leading ends thereof tapered. An unduly large addition to the latter length (the length of the limited-length fibers for fluffy raised piles), however, entails the disadvantage that the cost of production of the fur-like pile fabric will increase because the application rate of the alkali treating agent possessing enhanced viscosity as specifically described hereinafter must be increased and the proportion of under-fur fibers undergoing decomposition is increased.

Figure 4:
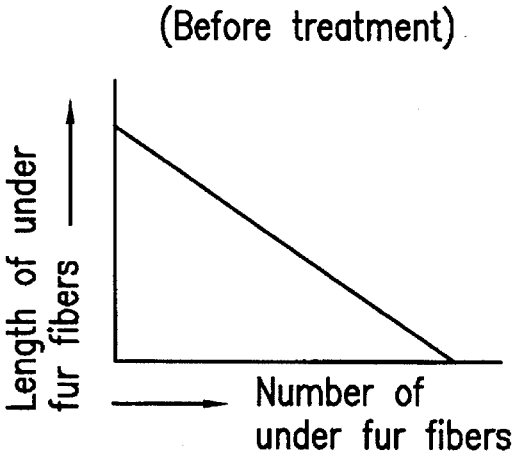
FIG. 4 is a diagram illustrating raised hair length distribution of the untreated pile fabric in the state as shown in FIG. 2 (*a*).

The under-fur fibers, while in the state preceding the treatment of decomposition as illustrated in FIG. 2 (*a*), have a raised hair length distribution as illustrated in FIG. 4. It is noted that the raised hair lengths are distributed from near zero to the proximity of the length of limited-length fibers for under-fur fibers.

Then, to the raised piles of the pile fabric, a layer 6 of an alkali treating agent having the viscosity specifically adjusted to a level in the range of from 100 to 500 poises is applied with a coater as illustrated in FIG. 2 (*b*). The pile fabric thus coated with the alkali treating agent is subjected to a dry heat treatment or a wet heat treatment so as to dissolve and decompose the longer portions of the under-fur fibers. It is then washed with water to be deprived of the dross resulting from decomposition. As a result, the pile fabric is now furnished with under-fur fibers that have hairs raised to a uniform length from the ground construction and tapered at the leading ends thereof as illustrated in FIG. 2 (*c*). The lengths of the under-fur fibers from the ground construction are distributed as illustrated in FIG. 5.

Figure 5:
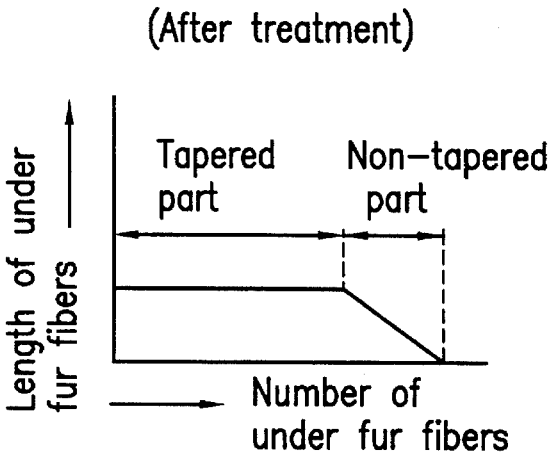
FIG. 5 is a diagram illustrating raised hair length distribution of the treated pile fabric in the state as shown in FIG. 2 (*c*).
Figure 7A:
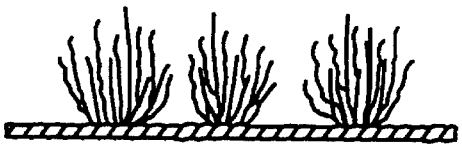
FIGS. 7 (*a*) to (*d*) are model diagrams aiding in the description of the method of this invention involving a procedure in which the surface of a pile fabric having an alkali treating agent applied thereto is pressed by the use of nip rolls with a fixed clearance retained thereon.
Figure 7B:
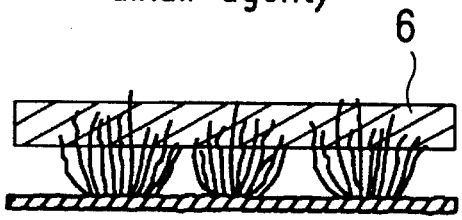
Figure 7C:
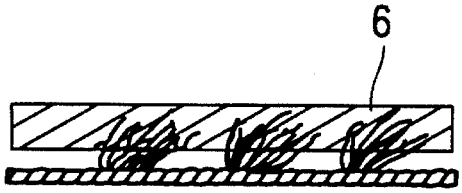
Figure 7D:
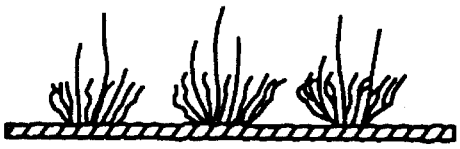

To be specific, the curve of the under-fur fibers length distribution is a flat portion as illustrated in FIG. 5. The flat portion of the length distribution curve represents the part of the raised piles that have been shortened to a uniform length and tapered in consequence of the solution and decomposition mentioned above.

The expression "the under-fur fibers possess a part of a uniform length" as used in this invention refers to those under-fur fibers whose lengths describe a distribution curve as illustrated in FIG. 5. In the part of short tapered hairs of a uniform length shown in the diagram, the lengths of individual under-fur fibers may be dispersed to a slight extent. According to the knowledge acquired by the inventors, the lengths of the individual under-fur fibers in the part of uniform length mentioned above may be generally dispersed within the range of about ±25% of the average length of the under-fur fibers in that part. In this invention, any dispersion on this order is accepted as having no effect on the definition of "uniform length."

In this invention, about 20 to 80% of the total number of under-fur fibers is accounted for by short tapered hairs of uniform length. This ratio is fixed by the original length of the fibers used as raw material for under-fur fibers and the "uniform length of under-fur fibers after the treatment." When fibers 20 mm in length are used as raw material for under-fur fibers, processed and incorporated in a pile fabric, and then shortened to 10 mm and tapered by the alkali treatment, then the shortened and tapered hairs account for roughly 50% of the total number of under-fur fibers.

Particularly important for this invention is the alkali treating agent having the viscosity thereof improved with a viscosity enhancer and the method for the impartation of the enhanced viscosity. As the alkali treating agent, such alkali metal compounds as sodium hydroxide, potassium hydroxide, and sodium carbonate can be used.

In the case of polyester type fibers, it is particularly desirable to use sodium hydroxide or potassium hydroxide in view of the cost of the chemical agent, the ease of handling, and the ease of waste water disposal. The concentration in which the hydrolyzing agent is used is not particularly restricted but may be properly selected depending on the kind, thickness, and cross-sectional shape of synthetic fibers to be treated, the method of treatment, etc. If the concentration is excessively high, the guard hair fibers are hydrolyzed possibly to the extent of losing their original shape. For safe treatment of the fibers, therefore, selection of the optimum concentration is essential. It is desirable to use the hydrolyzing agent in conjunction with a hydrolysis accelerator. The accelerators that are effectively usable herein include such quaternary ammonium salts as cetyl trimethyl ammonium chloride, cetyl triethyl chloride, and lauryl dimethylbenzyl ammonium chloride, for example.

The expression "viscosity enhancer" as used in this invention refers to a substance that in addition to the treating agent, enables an increase in the viscosity of this treating agent. The degree of this viscosity is generally expressed in poises. As the viscosity enhancer that behaves as described above, those substances that are generally referred to as sizing agents may be used. Water-soluble polymers are similarly usable.

The viscosity enhancer and/or hydrolyzing agent mentioned above should not be decomposed, should be inexpensive, and readily removed from fiber bundles after the treatment solidified by the aforementioned for sharpening the ends of fibers. The substances that answer this description include natural sizing agents, semisynthetic sizing agents, and synthetic sizing agents such as starch, rice bran, tragacanth gum, sodium aliginate, locust bean gum, methyl cellulose, carboxymethyl cellulose, nauca crystal gum, polyvinyl alcohol, polyvinyl acetate, and polysodium acrylate, and water-soluble polymers, for example.

Owing to the incorporation of the viscosity enhancer in the treating agent, this invention enables the uniform layer of the alkali treating agent of enhanced viscosity to be retained as indicated by 6 in FIG. 2 (*b*) on the surface of raised piles of the pile fabric. The viscosity of the treatment agent, therefore, must exceed 100 poises, preferably 150 poises. If the viscosity is less than 100 poises, the treatment for shortening and sharpening the under-fur fibers cannot be effectively attained because the alkali treating agent permeates the root parts of the raised piles and the ground construction as well. Conversely, if the viscosity exceeds 500 poises, the treatment for shortening and sharpening the under-fur fibers is obtained only with difficulty because the alkali treating agent is not allowed to properly permeate the interior of the layer of raised piles.

The "viscosity" as used in this invention refers to the viscosity of the treating liquid in its formulated form and not to the viscosity included among the treating conditions that will be described more specifically herein below. The magnitudes of viscosity as reported in this invention are those that have been determined at 20°±5° C. by means of a viscosimeter, Type B, under the conditions of rotary No. 4 and 12 rpm.

The impartation of the alkali treating agent possessing the aforementioned viscosity may be attained by using any of the known high-viscosity grade coating machines such as, for example, flat screen, rotary screen, knife coater, reverse roll coater, and curtain coater. The amount of the alkali treating agent to be imparted may be varied proportionate to the length in which the under-fur fibers are desired to be raised from the ground construction. Roughly, this length is in the range of from 100 to 1,000 g/m$^2$.

After the impartation of the alkali treating agent, the fabric is heat-treated to dissolve and decompose the leading terminal parts of under-fur fibers. For the heat treatment, any of such means as dry heat, normal pressure wet heat, high pressure wet heat, super wet heat, high frequency wave, and microwave may be used.

Concerning concrete conditions of heat treatment, generally about 3 to 10 minutes' wet heat treatment at 100° C. or about 3 to 10 minutes' dry heat treatment at 130° C. invariably under normal pressure is sufficient when the alkali treating agent to be used therein comprises an aqueous 10 to 30% sodium hydroxide solution and about 0.2 to 5% of a hydrolysis-promoting agent added for increasing viscosity. These conditions are suitably variable with the kind, thickness, and number of under-fur fibers to be treated for decomposition.

Incidentally, in accordance with the inventors' knowledge, as desirable limited-length fibers for guard hair fibers, it is advantageous to use polybutylene terephthalate fibers or polyethylene terephthalate fibers having a length approximately in the range of from 10 mm to 90 mm and a thickness approximately in the range of from 3 deniers to 100 deniers, depending on the conditions of the treatment with the alkali treating agent described above. In contrast, as limited-length fibers for under-fur fibers, it is advantageous to use polyethylene fibers or fibers of a copolymer having polyethylene terephthalate as a main component thereof, having a length approximately in the range of from 10 mm to 90 mm and a thickness approximately in the range of from 0.5 denier to 10 deniers. The effect of the alkali treatment on the under-fur fibers can be substantially minimized and the treatment for shortening and sharpening the under-fur fibers can be advantageously effected by selecting the combination of limited-length fibers for the guard hair fibers and the limited-length fibers for the under-fur fibers and further properly selecting the concentration of the alkali treating agent, the time and temperature of the treatment, the method of the treatment, etc.

For the purpose of producing an ideal fur-like appearance of a layer of raised piles and further for the purpose of enabling the alkali treating agent of the aforementioned specific viscosity to permeate properly in the inner layer of pile, the inventors' knowledge indicates that the density of the raised piles is desired to be in the range of from 5,000 to 50,000 ends/cm$^2$. This range, however, is variable with the weave density or knit density of the pile threads, the thickness of the pile threads, the thickness of fibers for raised piles to be used in the pile threads, etc.

For the purpose of ensuring a formation of a layer of raised piles in a clear two-layer construction, there may be employed a method that forces permeation of the alkali treating agent into the layer of raised piles by positive artificial means.

For example, a method that comprises pressing the layer of raised piles with nip rolls either after or simultaneously with the impartation of the alkali treating agent to the layer of raised piles thereby causing the alkali treating agent to permeate the interior of the layer of fibers for raised piles and thereafter subjecting the layer of raised piles to a heat treatment proves effective in obtaining a desired two-layer construction as ideally controlled.

In this case, the nip rolls are desirably adapted to maintain fixed clearance for exerting pressure on the pile surface.

FIGS. 7 (*a*) to (*d*) are model diagrams illustrating a typical process of stages through which the treatment proceeds. FIGS. 7 (*a*) and (*b*) are similar diagrams as those of FIGS. 2 (*a*) and (*b*). FIG. 7 (*c*) represents the piled fabric that has undergone pressure with the nip rollers subsequent to the alkali treatment. FIG. 7 (*d*) illustrates the piled fabric that has undergone the same treatment as that of FIG. 2 (*c*).

The coating with the alkali treating agent and the pressing with the nip rollers are intended to impart, as with a roller coater 7, a layer 6 of an alkali treating agent having viscosity in the range of from 100 to 500 poises and press this layer with nip rolls 8 adjusted to interpose a fixed clearance therebetween, with the result that the piled threads will be laid down in a fixed direction with an increase in the density of raised fibers and, at the same time, the alkali treating agent of consequently increased viscosity will permeate, to a uniform depth, the piled threads as illustrated in FIG. 7 (*c*).

When the fabric currently assuming the state illustrated in FIG. 7 (*c*) is subjected to a heat treatment with dry heat or wet heat to dissolve and decompose the under-fur fibers and the product of decomposition is removed by washing with water, a piled fabric that possesses parts in which under-fur fibers are raised from the ground construction to a substantially uniform length and these under-fur fibers have their leading terminals sharpened as illustrated in FIG. 7 (*d*).

In the process described above, the pressing with the nip rollers may be effected simultaneously with the impartation of the alkali treating agent of enhanced viscosity. This process may be attained by having either of the nip rolls concurrently serve as a coating roll for the alkali treating agent.

The clearance to be formed between the nip rolls is desired to be such that the nip rolls press the piled fabric to a thickness falling in the range of from 0.3 to 0.7 times the thickness of the fabric before the impartation of the alkali treating agent (under a load of 100 g/cm$^2$). By applying pressure in this range and consequently obtaining a state as illustrated in FIG. 7 (*c*), the layer of under-fur fibers is clearly different from the layer of guard hair fibers and these under-fur fibers have high uniformity after losing weight. When the pressure is so high as to crush the layer of raised piles, making the length of under-fur fibers uniform as desired and shortening them is not sufficiently manifested.

If the clearance of the nip rolls is less than 0.3 times the original thickness of the fabric, though the pressure is strong enough for the permeation of the alkali treating agent to reach a great depth, the fluffy fibers are not completely decomposed after the heat treatment but remain thin and the produced piled fabric tends to assume a hazy feeling and poor appearance. Conversely, if the clearance exceeds 0.7 times the original thickness of the fabric, though the heat treatment causes a decrease in the amount of under-fur fibers so as to permit clear discrimination between the two layers, the decrease of the amount does not proceed to the length of under-fur fibers aimed at and, consequently, the produced piled fabric generally acquires a high basis weight.

When the dissolution and decomposition of fluffy fibers have been completed, the fabric is washed with hot water and then dried. In the piled fabric obtained as described above, the fluffy fibers are shortened and sharpened in the leading terminals thereof. The piled fabric, therefore, possesses parts in which under-fur fibers are raised to a uniform length from the ground construction as illustrated in FIG. 2 (*c*) and FIG. 5. After drying, the piled fabric may be suitably raised, trimmed, and given a treatment with a finishing agent.

Desirably, the piled fabric is processed so that the basis weight thereof will fall approximately in the range of from 400 to 600 g/m$^2$.

The forced permeation of the alkali treating agent into a layer of raised hairs may be attained by a method that comprises placing a flat plate on the piled fabric and pressing this flat plate down onto the piled fabric either after or during the impartation of the alkali treating agent of enhanced viscosity, a method that comprises using a pressing member of the form of a blade or a comb, a method that comprises spraying compressed air onto the piled fabric in the direction in which the alkali treating agent is imparted to the layer of raised piles, or a method that comprises aspirating the ambient air off the surface of the piled fabric to which the alkali treating agent has been imparted besides the aforementioned method resorting to use of the nip rolls. In accordance with the outcome of the inventors' study, the method resorting to the use of the nip rolls proves advantageous because it fits a continuous process of fabrication and allows easy control.

Figure 3:
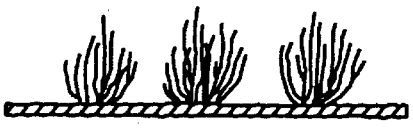
FIG. 3 is a schematic model side view of a pile fabric produced by the conventional method.
Figure 6:
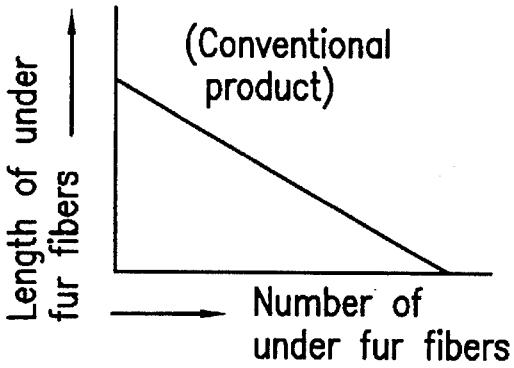
FIG. 6 is a diagram illustrating raised hair length distribution of the pile fabric as shown in FIG. 3 produced by the conventional method.

The conventional fur-like piled fabric that is produced by the conventional technique disclosed in Japanese Unexamined Patent Publications No. 57(1982)-61,741 and No. 57(1982)-95,342 is generally a piled fabric that comprises guard hair fibers having opposite terminal parts thereof sharpened and under-fur fibers having a smaller length than the guard hair fibers and having opposite terminal parts thereof sharpened. Similar to the guard hair fibers, the under-fur fibers have lengths thereof from the ground construction distributed from 0 to the proximity of the length of the limited-length fibers as illustrated in FIG. 3 and FIG. 6. As one pile bundle, the raised piles are an aggregate of fibers resembling a nib of a writing brush. From the standpoint of spinnability, the staple length of the limited-length fibers for flurry raised piles has its limit on the shorter side. Thus, the flurry hairs are not allowed to be shortened to the length of the guard hair fibers of this invention as illustrated in FIG. 2(*c*) and FIG. 5.

The treating method that comprises pressing the layer of raised piles with the nip rolls having a fixed clearance inserted therebetween thereby inducing permeation of the alkali treating agent of the aforementioned specific viscosity into the layer of raised fibers either after or simultaneously with the impartation of the alkali treating agent to the layer of raised piles and thereafter subjecting the pressed layer of raised fibers to a heat treatment thereby shortening the raised piles and, at the same time, sharpening the leading terminals of the raised piles may be performed on a fabric of raised piles that do not combine the two kinds of raised piles, i.e. the guard hair fibers and the under-fur fibers, namely on a piled fabric formed solely of guard hair fibers or under-fur fibers. In this case, the treating method gives birth to a fur-like piled fabric that comprises raised piles of a small yet uniform length sharpened at the leading terminal parts thereof.

Now, the fur-like piled fabric of this invention and a method for the production thereof will be described more specifically below with reference to working examples.

EXAMPLE 1

A spun yarn (60 s/2) of polyester staple fibers 1.2 d×51 mm was used for the warp and weft of a matrices fabric. A pile yarn of mixed fibers 15 s was prepared by helically winding a filament of water-soluble polyvinyl alcohol (PVA) around a spun yarn consisting of 40% by weight of fibers of polybutylene terephthalate staple 40 d×23 mm having tapered opposite terminals formed by the method disclosed in Japanese Unexamined Patent Publication No. 38,922/1979 as limited-length fibers for guard hair fibers and 60% by weight of fibers of crimped polyethylene terephthalate staple 2 d×22 mm as limited-length fibers for under-fur fibers. A warp piled woven fabric was formed with this pile yarn. The product excelled in both spinnability and weaving property.

The product was a 16-excess fast pile having a ground construction density of 96 warps×43 wefts/2.54 cm and a pile density of 96 warps/2.54 cm. The weaving conditions were set so as to give a pile height (length of pile interconnecting the upper and lower double woven fabrics) of 23 mm. The double woven fabric thus obtained could be separated into two, i.e. one upper and one lower, pile fabrics by causing dissolution of the water-soluble PVA filaments, thereafter applying a sliding separation on force on the upper and lower matric fabrics without entailing any severance of pile fibers and consequently inducing simple removal of fibers. The gray fabrics consequently produced were given a backing treatment with an aqueous 35% acryl resin solution, dried, and treated with a raising device to remove loosed straight raised fibers and fluffy raised fibers from the ground construction and groom the remaining raised fibers. Then, a water-soluble alkali treating agent containing 20% of sodium hydroxide, 5% of a starch type viscosity enhancer, and 2% of a quaternary ammonium type decomposition accelerator was prepared. The viscosity of this treating agent as measured with a B type viscosimeter was 230 poises (at 20° C.). The hair-raised surface of the pile fabric was coated with this treating agent at an application rate of 1,400 g/m$^2$ with a reverse roll coater, steamed with a normal-pressure wet heat treating device at 100° C. for five minutes, washed with hot water, washed with an acid, and dried.

On the produced pile fabric, the guard hair fibers had a maximum length of about 21 mm and the under-fur fibers included a part in which the hairs raised from the ground construction had a substantially uniform length of about 9 mm. The raised piles in this part having uniform length mentioned above had tapered terminals. A close examination of a small sample (10 cm×10 cm) of this pile fabric revealed that roughly 50% of the whole under-fur fibers were shortened and tapered under-fur fibers 9 mm long. The pile fabrics were subsequently dyed using a liquid flow dyeing device, treated with a finishing agent, and then subjected to a treatment with a raising device to groove the raised piles.

The finished pile fabric resembles natural fur in form as illustrated in FIGS. 1 (*a*) and (*b*). It turned out to be an excellent high-quality fur-like pile fabric that closely resembles mink comprehensively in point of appearance, softness of tough, gloss, depth of color, ability to yield to external pressure, and be restored to the original shape and has a voluminous feeling.

The fur-like pile fabric was tested for liability to forced entanglement of raised piles by the use of an antipilling tester and consequently found to possess a low liability to entanglement of under-fur fibers with one another or guard hair fibers with under-fur fibers.

The produced pile fabric had a basis weight of about 550 g/m$^2$, a value about 100 g/m$^2$ lower than the value common to the conventional product. This difference was prominent when a coat made of the fur-like pile fabric was actually worn.

EXAMPLE 2

Pile yarns were prepared in the same manner as in Example 1, using polyester filaments of 50 deniers and 24 filaments for both front yarns and back yarns. A ground construction half tricot was knitted by a double russel knitting device using the pile fibers.

The knitting conditions were set so as to provide a matric density of 22 gauges of wale per inch and 30 gauges of course per inch and 20 mm of pile height (length of interconnecting pile between the upper and lower knitted fabrics). A gray woven fabric consequently produced was subjected to backing, raising, and alkali treatments under the same conditions as in Example 1.

On a pile fabric consequently obtained, the guard hair fibers had the largest length of about 20 mm and the under-fur fibers included a part in which the raised piles have a uniform length of about 9 mm. The raised piles of uniform length had the leading terminals thereof tapered.

Then a small sample (10 cm×10 cm) of this pile fabric was examined in the same manner as in Example 1, it was found that about 50% of the whole raised piles were shortened tapered hairs 9 mm in length.

Subsequently, the produced pile fabric was dyed, treated with a finishing agent, and subjected to a raising treatment under the same conditions as in Example 1.

A fur-like pile fabric obtained as described above resembled the product of Example 1 in form. Owing to the knitted texture, this fur-like pile fabric allowed an ample extension in both the longitudinal and lateral directions, enjoyed softness, and exhibited a draping property compared with the fur-like pile fabric of the woven texture produced in Example 1. The basis weight of this pile fabric was about 580 g/m$^2$.

When a half coat made of this pile fabric was worn, it was found to fit the wearer's body comfortably.

EXAMPLE 3

A spun yarn (60 s/2) of polyester staple fibers 1.2 d×51 mm was used for the warp and weft of the ground construction. A pile yarn of mixed fibers 15 s was prepared consisting of a spun yarn consisting of 40% by weight of fibers of polybutylene terephthalate staple 18 d×18 mm having tapered opposite terminals formed by the method disclosed in Japanese Unexamined Patent Publication No. 38,922/1979 as limited-length fibers for guard hair fibers and 60% by weight of fibers of crimped polyethylene terephthalate staple 2 d×18 mm as limited-length fibers for under-fur fibers. A warp piled woven fabric was formed with this pile yarn. The product excelled in both spinnability and weaving property.

Figure 8:
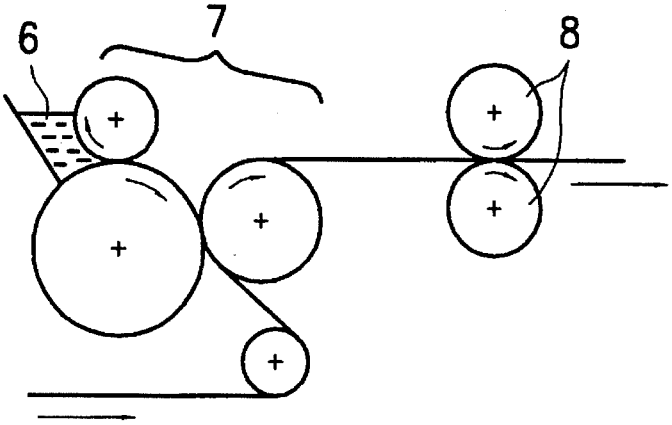
FIG. 8 illustrates, as a model, an example of the procedure of coating a pile fabric with the alkali treating agent and subsequently pressing the coated pile fabric by using nip rolls.

The product was a 16-excess fast pile having a ground construction density of a pile density of 96 warps/2.54 cm. The weaving conditions were set so as to provide a pile height (length of pile interconnecting the upper and lower double woven fabrics) of 18 mm. The gray fabric consequently produced was given a backing treatment with an aqueous 35% acryl resin solution, dried, and treated with a raising device to remove the loosed guard fibers and fluffy raised fibers separated from the ground construction and groom the remaining raised fibers. Then, a water-soluble alkali treating agent containing 20% of sodium hydroxide, 5% of a starch type viscosity enhancer, and 2% of a quaternary ammonium type decomposition accelerator was prepared. The viscosity of this treating agent as measured with a B type viscosimeter was 230 poises (at 20° C.). With the aid of a device constructed as illustrated in FIG. 8, the hair-raised surface of the pile fabric was coated with the treating agent mentioned above and applied with a reverse roll coater 7 at an application rate of 400 g/m$^2$. It was then pressed with nip rolls 8 having a clearance of 1.3 mm interposed therebetween. The coated fabric was placed horizontally by a normal temperature wet heat treating device, steamed at 100° C. for five minutes, washed with hot water, washed with an acid, and dried.

On the produced pile fabric, the guard hair fibers had a maximum length of about 16 mm and the under-fur fibers included a part in which the raised piles had a substantially uniform length of about 7 mm from the ground construction. The raised piles in this part having the uniform length mentioned above had tapered terminals. The amount of lost under-fur fibers was 120 g/m$^2$.

When a small sample (10 cm×10 cm) of this pile fabric was examined in the same manner as in Example 1, it was found that the number of shortened and tapered under-fur fibers of a uniform length of about 7 mm was about 50% of the total number of raised piles.

Subsequently, the pile fabric was dyed using a liquid flow dyeing device, treated with a finishing agent, and groomed with a raising device.

The finished pile fabric resembled natural fur in form as illustrated in FIG. 1 (*a*) or FIG. 7 (*d*). It turned out to be an excellent high-quality fur-like pile fabric that closely resembled mink comprehensively in point of appearance, softness of touch, gloss, depth of color, ability to yield to external pressure, ability to be restored to the original shape and has a voluminous feeling.

The fur-like pile fabric was tested for liability to forced entanglement of raised piles by the use of an antipilling tester and consequently found to possess low liability to entanglement of under-fur fibers with one another or guard hair fibers with under-fur fibers.

The produced pile fabric had a basis weight of about 530 g/m$^2$, a value about 120 g/m$^2$ less than the value common to the pile fabric was worn, it was found to be light and attractive compared with the coat made of the conventional pile fabric.

INDUSTRIAL PRACTICABILITY

The pile fabric of this invention closely resembles such high quality fur as mink, for example, and can be used as high quality fabricing such as coats and jackets. Since this invention obviates the necessity of killing animals for genuine furs, it contributes to the protection of animals.

We claim:

1. A pile fabric having a two-layer pile construction, said pile fabric comprising:

a ground construction;

guard hair fibers connected to said ground construction and having various raised lengths ranging from about zero to a maximum guard hair fiber length, each said guard hair fiber being tapered and having a thickness not less than about 3 denier and not more than about 100 denier, said guard hair fibers being formed from polybutylene terephthalate or a copolymer having polybutylene terephthalate as a main component thereof; and under-fur fibers connected to said ground construction and having various raised lengths and a maximum under-fur fiber length not exceeding about 70% of said maximum guard hair fiber length, about 20% to 80% of said under-fur fibers having a substantially uniform length substantially corresponding to said maximum under-fur fiber length, said under-fur fibers with said substantially uniform length having tapered leading ends, said under-fur fibers being formed from polyethylene terephthalate or a copolymer having polyethylene terephthalate as a main component thereof, and said under-fur fibers being less resistant to chemical treatment than said guard hair fibers, each said under-fur fiber having a thickness not more than about 5 denier.

2. A pile fabric having a two-layer construction comprising a ground construction; guard hair fibers connected to said ground construction and formed from a guard hair material, said guard hair fibers having tapered ends and a maximum guard hair fiber length; and under-fur fibers connected to said ground construction and formed from an under-fur material that is less resistant to a chemical treatment agent than said guard hair fiber material, said under-fur fibers having a maximum under-fur fiber length, about 20% to 80% of said under-fur fibers having a substantially uniform length substantially corresponding to said maximum under-fur fiber length, said under-fur fibers with said substantially uniform length having tapered ends; said pile fabric being produced by steps including:

(a) forming a preliminary pile fabric with a hair raised surface from under-fur staple fibers and guard hair staple fibers;

(b) preparing said chemical treatment agent with a viscosity greater than 150 poise to about 500 poise;

(c) applying a substantially uniform layer of said chemical treatment agent on said hair raised surface by coating said hair raised surface of said preliminary pile fabric with said chemical treatment agent;

(d) forcing permeation of said chemical treatment agent into at least a portion of said hair raised surface by pressing said hair raised surface after said hair raised surface is coated with said chemical treatment agent; and (e) shortening a portion of said under-fur staple fibers to said substantially uniform length substantially corresponding to said maximum under-fur fiber length and providing said under-fur staple fibers having said substantially uniform length with said tapered leading ends by treating said hair raised surface pressed with said chemical treatment agent.

3. A method for producing a pile fabric having a two-layer pile construction, said method comprising the steps of:

(a) providing polyester guard hair fibers with tapered ends and polyester under-fur fibers that are less resistant to alkali treatment than said guard hair fibers;

(b) blending said guard hair fibers with said under-fur fibers to form pile fibers;

(c) knitting or weaving said pile fibers to form a double woven fabric;

(d) separating said double woven fabric to form a pile fabric having a hair raised surface and a rear side;

(e) applying a backing treatment to said rear side of said pile fabric;

(f) providing an alkali treating agent having a viscosity greater than 150 poise to about 500 poise and coating said hair raised surface of said pile fabric with said alkali treating agent;

(g) forcing said alkali treating agent to permeate at least a portion of said hair raised surface of said pile fabric by pressing said pile fabric after said pile fabric is coated with said alkali treating agent; and (h) shortening a portion of said under-fur fibers to a substantially uniform maximum under-fur fiber length not exceeding about 70% of a maximum guard hair fiber length and sharpening leading ends of said portion of said under-fur fibers by subjecting said pile fabric pressed with said alkali treating agent to a dry heat treatment or a wet heat treatment.

4. The method set forth in claim 3, wherein said step of providing said polyester guard hair fibers and said polyester under-fur fibers includes forming said guard hair fibers from polybutylene terephthalate or a copolymer having polybutylene terephthalate as a main component thereof and forming said under-fur fibers from polyethylene terephthalate or a copolymer having polyethylene terephthalate as a main component thereof.

5. The method set forth in claim 3, wherein said step of pressing said pile fabric is effected using nip rolls.

6. The method set forth in claim 3, wherein said dry heat treatment is performed at about 130° C. for about 3 to 10 minutes.

7. The method set forth in claim 5, wherein said nip rolls press said pile fabric to a thickness in the range of about 0.3 to 0.7 times the thickness of said pile fabric prior to said step of pressing.

8. The method set forth in claim 3, wherein said wet heat treatment is performed at about 100° C. for about 3 to 10 minutes.

* * * * *